US007507050B2

(12) United States Patent
McCue et al.

(10) Patent No.: US 7,507,050 B2
(45) Date of Patent: Mar. 24, 2009

(54) ADJUSTABLE BOLLARD

(75) Inventors: David S. McCue, Manchester, MA (US); Daniel B. Ballou, Salem, MA (US); Adam P. Stevens, York, ME (US); Brent Hild, Belmont, MA (US); Teodoro A. Mesa, Lynn, MA (US); Genesis J. McDermott, Chicago, IL (US)

(73) Assignee: McCue Corporation, Salem, MA (US)

( * ) Notice: Subject to any disclaimer, the term of this patent is extended or adjusted under 35 U.S.C. 154(b) by 0 days.

(21) Appl. No.: 12/009,167

(22) Filed: Jan. 17, 2008

(65) Prior Publication Data

US 2008/0187396 A1 Aug. 7, 2008

Related U.S. Application Data

(63) Continuation-in-part of application No. 11/800,233, filed on May 4, 2007, which is a continuation-in-part of application No. 11/633,935, filed on Dec. 5, 2006.

(60) Provisional application No. 60/742,660, filed on Dec. 6, 2005.

(51) Int. Cl.
*E01F 13/00* (2006.01)

(52) U.S. Cl. ..... 404/6; 404/9

(58) Field of Classification Search ..... 404/6, 404/9–11

See application file for complete search history.

(56) References Cited

U.S. PATENT DOCUMENTS

| | | | | |
|---|---|---|---|---|
| 1,999,920 | A | 4/1935 | Wolfson | |
| 3,952,453 | A | 4/1976 | Amburgey | |
| 4,198,036 | A | 4/1980 | O'Neal | |
| 5,011,326 | A * | 4/1991 | Carney, III | 404/6 |
| 5,033,905 | A | 7/1991 | Schmidt et al. | |
| 5,507,473 | A | 4/1996 | Hammer et al. | |
| 5,566,926 | A | 10/1996 | Voigt | |
| 5,891,534 | A | 4/1999 | Sabin et al. | |
| 5,899,628 | A | 5/1999 | Pei-Chi et al. | |
| 6,203,241 | B1 | 3/2001 | Gertz | |
| 6,260,237 | B1 | 7/2001 | McCue et al. | |
| 6,579,034 | B1 | 6/2003 | Welch et al. | |
| 6,619,630 | B2 | 9/2003 | Albritton | |
| 6,623,204 | B2 | 9/2003 | Buehler | |
| 6,848,857 | B1 | 2/2005 | McColl et al. | |
| 6,945,730 | B1 | 9/2005 | Lobban et al. | |
| 2005/0152744 | A1 | 7/2005 | Straub | |
| 2007/0031189 | A1 * | 2/2007 | Stadler | 404/6 |

FOREIGN PATENT DOCUMENTS

| | | |
|---|---|---|
| FR | 2424982 | 11/1979 |
| GB | 2207692 | 2/1989 |

OTHER PUBLICATIONS

International Search Report for Application No. PCT/US2006/046406, dated Mar. 29, 2007.
Written Opinion for Application No. PCT/US2006/046406, dated Mar. 29, 2007.

* cited by examiner

*Primary Examiner*—Raymond W Addie
(74) *Attorney, Agent, or Firm*—Lahive & Cockfield, LLP

(57) ABSTRACT

An adjustable bollard is formed of a rigid post body to absorb impact forces. At least two leg portions support the rigid post body. The distance dimension between the leg portions is adjustable to enable minor variations in the placement of the mounting holes into which the leg portions fit to install the bollard in the ground or floor.

16 Claims, 16 Drawing Sheets

ADJUSTABLE BOLLARD

RELATED APPLICATIONS

The present invention is a continuation-in-part of U.S. patent application Ser. No. 11/800,233, filed on May 4, 2007 and entitled "Adjustable Bollard", and a continuation-in-part of U.S. patent application Ser. No. 11/633,935 filed Dec. 5, 2006, and entitled "Adjustable Rigid Corner Guard", which claims priority to Provisional Application No. 60/742,660 filed Dec. 6, 2005. The contents of both U.S. patent application Ser. No. 11/800,233 and U.S. patent application Ser. No. 11/633,935 are herein incorporated by reference in their entirety.

FIELD OF THE INVENTION

The present invention relates generally to a bollard with an adjustable mount for protecting structures from moving objects, controlling or directing a flow of traffic of heavy equipment, carts or vehicles, and/or blocking access to particular areas, and relates more particularly to a bollard with an adjustable mount employing a rigid post body and legs for mounting the post having an adjustable distance therebetween.

BACKGROUND OF THE INVENTION

In supermarkets and retail stores floor fixtures such as freezer and refrigerator cases, floor shelving, and product displays are susceptible to damage due to collisions with shopping carts, floor scrubbers, pallet jacks, stock carts, and the like. For example, freezer and refrigerator cases typically include a glass or transparent plastic door for viewing the product without opening the door. The glass can be shattered, or the plastic scratched, upon impact with shopping carts, or the like. Since the body of many of these floor fixtures is constructed of lightweight aluminum or hardened plastic, it can be easily dented or cracked by such impacts.

A bollard is commonly used to protect floor fixtures from collisions with shopping carts and heavy equipment. Bollards are also commonly employed inside a store to block shopping cart access to certain areas and outside a store to protect outdoor structures from collisions, to indicate parking areas, to block vehicle and heavy equipment access to a particular area, and to direct a flow of traffic. Bollards can also be used to block vehicular access for security reasons. While some bollards are permanently fixed in place, others need to be removable to temporarily permit access to an area, or when a change in location is required.

Bollards can be difficult to mount to a floor or to the ground, often requiring large diameter holes or cement to be held in place. The large diameter hole for mounting a bollard can be difficult to make in the floor or in asphalt, concrete, etc., and if the bollard is removed, the very large diameter hole in the floor, in a sidewalk or in a parking lot is a hazard. Bollards held in place with cement are not easily installed and are not easily removed. Alternatively, a bollard can be mounted using two or more smaller diameter legs that are attached to the body of the bollards. The legs fit into two or more smaller holes in the floor or the ground. If the bollard is removed, the two or more small holes in the floor or the ground do not present as great a hazard. The two or more smaller holes are easier to form in the floor or ground than the single large diameter hole, however, unlike the single large diameter hole that does not require precise positioning, the two or more smaller mounting holes must be precisely spaced for the two or more legs to align with the two or more smaller mounting holes. The bollard with legs requires a significant degree of precision when one is forming the mounting holes into which the legs are positioned to install the bollard. If the mounting holes are not precisely spaced, the two or more legs may not fit well, and/or may not fit at all.

Accordingly, what is needed is a bollard for use where collisions with other equipment may occur, while also providing some degree of adjustment with regard to the installation of the bollard. The present invention is directed to this need.

SUMMARY OF THE INVENTION

In accordance with one example embodiment of the present invention, a bollard with an adjustable mounting mechanism includes a rigid post body having a first end and a second end. A first leg couples with the rigid post body at the second end. A second leg couples with the post rigid post body at the second leg substantially parallel with the first leg, the second leg coupled with the rigid post body through an adjustable support. The adjustable support is configured to vary a distance between the first leg and the second leg upon adjustment. A sliding support slidably couples with the first leg, the second leg, or both.

In accordance with various aspects and embodiments of the present invention, wherein the sliding support can be fixedly coupled with the rigid post body and slidably coupled with the first leg. The second leg can be affixed to the rigid post body and the sliding support can be affixed to the second leg.

In accordance with additional aspects and embodiments of the present invention, the adjustable support can include a threaded bolt. The rigid post body can include a threaded channel configured to engage threads on a portion of the adjustable support. The second leg can include a threaded channel configured to engage threads on a portion of the adjustable support.

In accordance with additional aspects and embodiments of the present invention, rotation of the adjustable support about a longitudinal axis of the adjustable support varies the predetermined distance between the first leg and the second leg. The adjustable support can include a driving head for rotating the adjustable support about the longitudinal axis of the adjustable support.

In accordance with additional aspects and embodiments of the present invention, the adjustable support can include a retaining element adapted to fix a translational position of the adjustable support relative to the first leg. The second leg can be affixed to an outward facing side of a wall of the rigid post body. The second leg can be affixed to an inward facing side of a wall of the rigid post body. The adjustable support can be configured to adjust the predetermined distance over a total range of about 0.5 inches.

In accordance with one example embodiment of the present invention, a bollard with an adjustable mounting mechanism includes a rigid post body having a first end and a second end. A leg structure couples with and supports the rigid post body. The leg structure includes a first leg coupled with the rigid post body at the second end, a second leg coupled with the rigid post body at the second end substantially parallel with the first leg, and an adjustable support having a first end rotatably coupled with the first leg and a second end adjustably coupled with the second leg. The adjustable support is configured to vary a distance between the first leg and the second leg upon adjustment. A sliding support slidably couples with the first leg and fixedly couples with the second leg.

In accordance with aspects and embodiments of the present invention, the first leg can include a first channel slidably engaged with the sliding support. The second leg can include a threaded channel threadedly engaged with the adjustable support. The adjustable support can include a threaded bolt having a driving head disposed at a first end and a threaded portion disposed at a second end; and a retaining element disposed on the threaded bolt adapted to retain the first leg in a desired position along a length of the threaded bolt. The first leg can be disposed between the driving head and the retaining element.

BRIEF DESCRIPTION OF THE DRAWINGS

The present invention will become better understood with reference to the following description and accompanying drawings, wherein.

DETAILED DESCRIPTION

Figure 1:
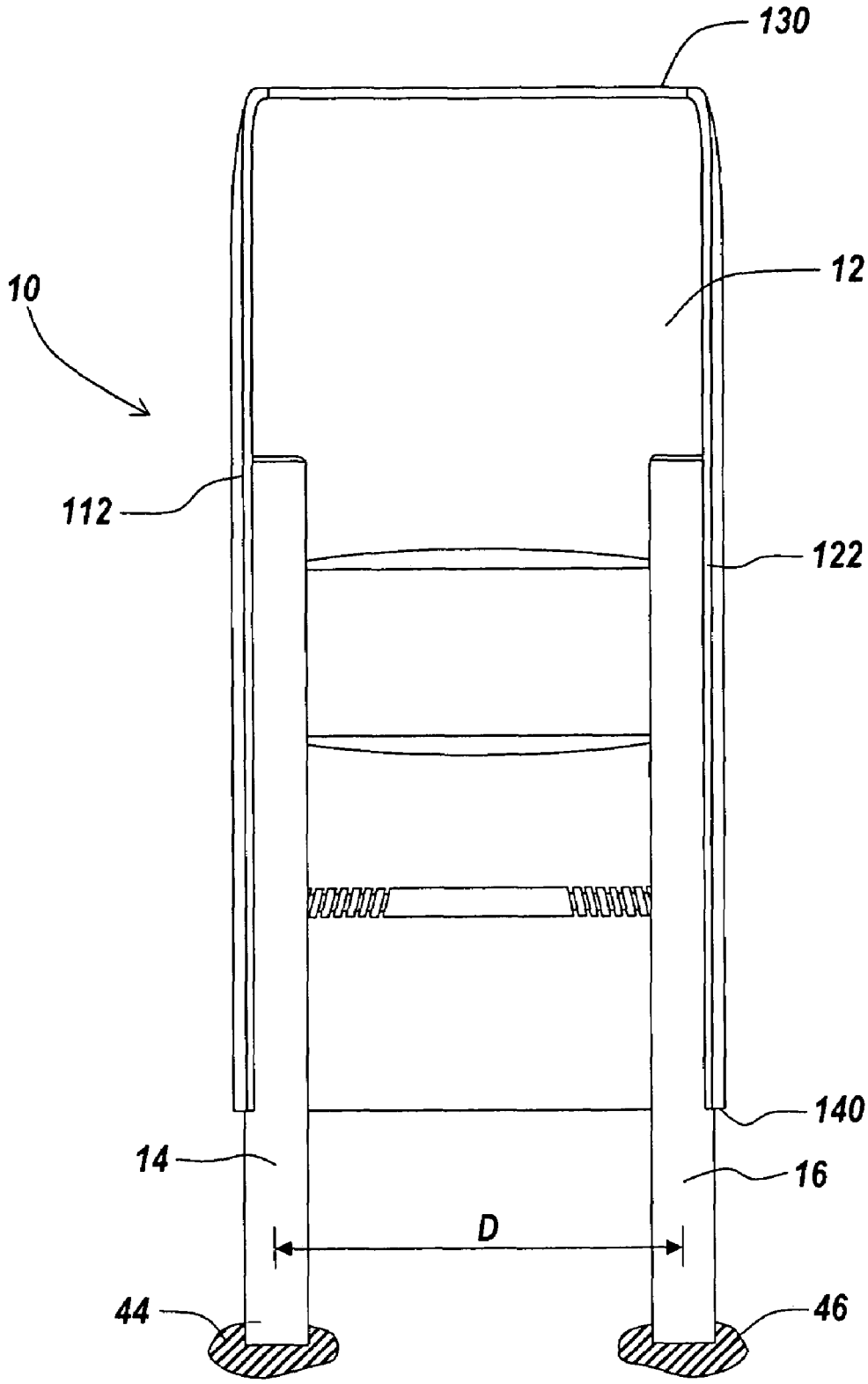
FIG. 1 is a diagrammatic back view of an adjustable rigid corner guard, according to one aspect of the present invention.
Figure 2:
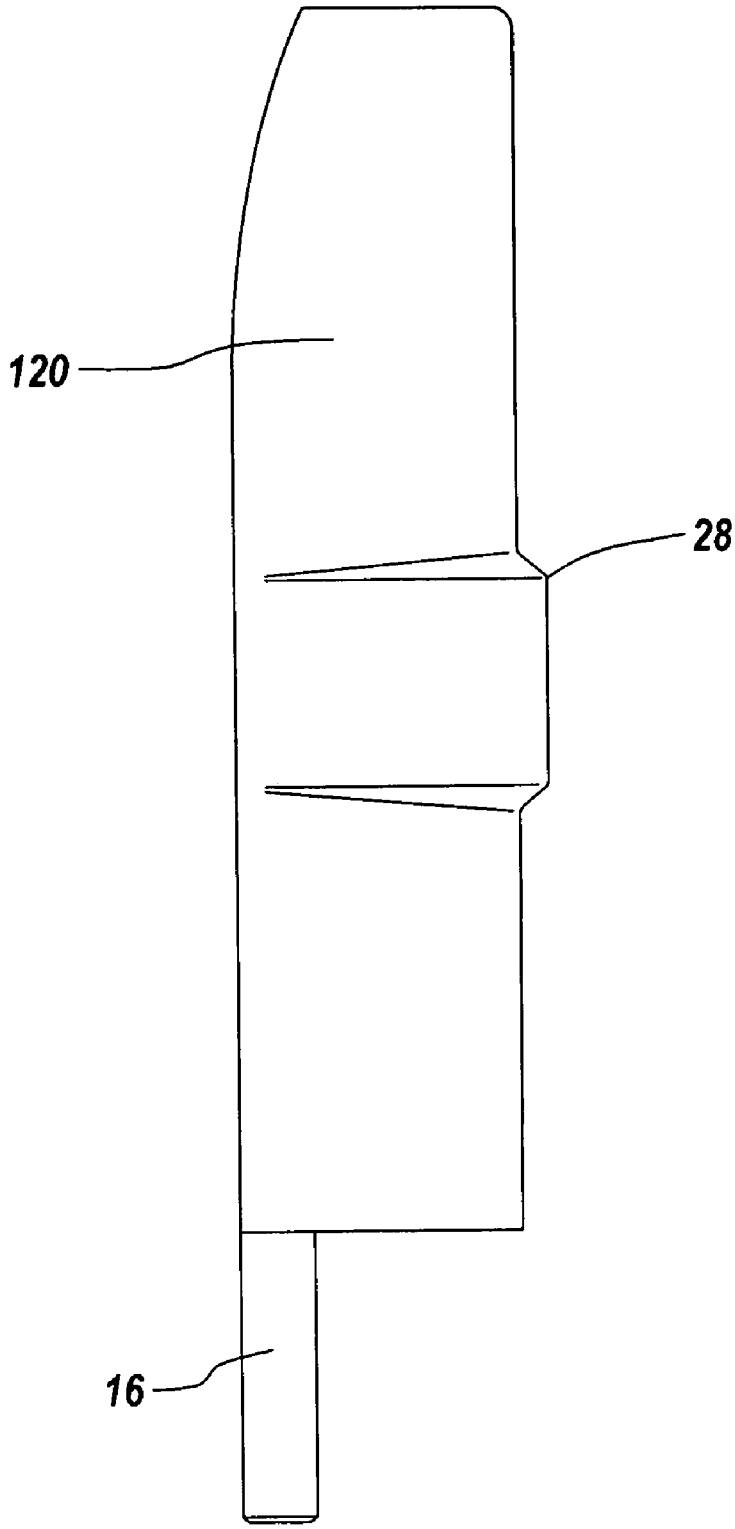
FIG. 2 is a diagrammatic side view of the adjustable rigid corner guard, according to one aspect of the present invention.

An illustrative embodiment of the present invention relates to an adjustable bollard in which one embodiment is formed of a rigid post body to absorb impact forces. The rigid body is constructed of a material, such as a metal or heavy composite for ease of cleaning and for good stability and impact absorption ability. Other types of material are considered within the scope of the invention. The material must be sturdy enough to absorb the impact of many collisions while maintaining an attractive appearance, and not easily fracturing or denting. One embodiment of the present invention further includes at least two leg portions that support the rigid post body. The distance dimension between the leg portions is adjustable to enable minor variations in the placement of the mounting holes into which the leg portions fit to install the bollard in the ground or floor.

FIGS. 1 through 7B, wherein like parts are designated by like reference numerals throughout, illustrate an example embodiment of an adjustable corner guard according to the present invention, FIGS. 8A through 13 illustrate example embodiments of an adjustable bollard according to the present invention and FIGS. 14A through 15B illustrate example embodiments of a bollard with an adjustable mounting mechanism. Although the present invention will be described with reference to the example embodiments illustrated in the figures, it should be understood that many alternative forms can embody the present invention. One of ordinary skill in the art will additionally appreciate different ways to alter the parameters of the embodiments disclosed, such as the size, shape, or type of elements or materials, in a manner still in keeping with the spirit and scope of the present invention.

FIG. 1 is a back view of an adjustable rigid corner guard 10 in accordance with one embodiment of the present invention. The adjustable rigid corner guard 10 has a bumper section 12, which serves to protect a corner upon which, or in front of which, the adjustable rigid corner guard 10 is mounted. The bumper section 12 can be formed of a number of different rigid and high strength materials, such as metal and high strength composites, and the like, to create a rigid body, so long as the material provides sufficient support and durability to protect a corner. The ability of a particular material to resist being dented or cracked when impacted with an object depends on the yield strength of the particular material (the force a material can withstand before being irreversibly deformed) and the facture toughness of the particular material (the material's resistance to brittle fracture when a crack is present). A material must have sufficient strength to resist being dented or deformed to be useful as a rigid corner guard. The tensile yield strength, expressed in units of millions of Pascals (MPa), is a standard measure of material strength. A material with sufficient strength may not be suitable for use as a corner guard because it may not be sufficiently tough. Such a material would not dent or deform during a collision, but it would crack. The fracture toughness, expressed in units of millions of Pascals multiplied by square root meters (MPa-$m^{1/2}$), is a standard measure of material toughness. The yield strength is normally expressed in units of millions of Pascals (MPa) and the fracture toughness is normally expressed in units of millions of Pascals multiplied by square root meters (MPa$\sqrt{m}$ or MPa-$m^{1/2}$).

In accordance with one example embodiment, the bumper section 12 is formed of a stainless steel metal. Table 1 shows yield strengths for readily available stainless steels, a common aluminum alloy, a common cold-rolled steel alloy, a range for all carbon steels, and two types of high density polyethylene (HDPE). As described above, many conventional corner guards are formed of plastics such as HDPE and lightweight aluminum. However, most plastics and many aluminum alloys do not have sufficient strength for use in a corner guard where collisions with heavier industrial type equipment can occur. The yield strength of most metal materials (pure and alloys) depends both on the chemical composition of the metal material and the way that the metal material is processed. Cold working and/or annealing of a metal material can greatly increase its strength. For this reason, typical values of yield strength for a particular metal material composition may cover a large range.

As can be seen in Table #1, aluminum alloys are much stronger than plastics, such as impact resistant HDPE. Some aluminum alloys are as strong as some types of stainless steel alloys, but the range of strengths is higher for stainless steel than for aluminum alloys. Additionally, stainless steel alloys are more tough (resistant to fracture) than aluminum alloys.

TABLE #1

| Material | Tensile Yield Strength in MPa | Fracture Toughness ($K_{1C}$) in MPa-$m^{1/2}$ |
|---|---|---|
| Stainless Steel AISI type 300 series | 210-415 (range includes 304, 304L, 304N and 304HN) | 100 (typical value for AISI 300 series) |
| Al alloy 6061-T6 | 276 (typical value) | 29 (typical value) |
| Cold Rolled Steel Common alloy 1008 | 180-240 | |
| Range for all Carbon Steels | 140-2750 | |
| High Density Polyethelene (HDPE), impact grade | 17-25 MPa (typical values) | ~1 |
| HDPE, ultra high molecular weight | 20-28 MPa (typical values) | ~1 |

Materials with a tensile yield strength of greater than about 190 Mpa and a fracture toughness greater than about 40 MPa-$m^{1/2}$ are sufficiently strong and tough to withstand collisions with heavier industrial type collisions when used to form the bumper section 12.

The adjustable rigid corner guard 10 further includes two or more legs, such as a first leg 14 and a second leg 16, upon which the bumper section 12 rests. The first and second legs 14, 16 are preferably fabricated from stainless steel to provide strength when the bumper section 12 receives an impact blow. Other materials may, of course, be utilized as long as the appropriate strength is retained, and first and second legs 14, 16 do not break under predictable impact. The first and second legs 14, 16 are spaced a distance D apart.

Figure 3A:
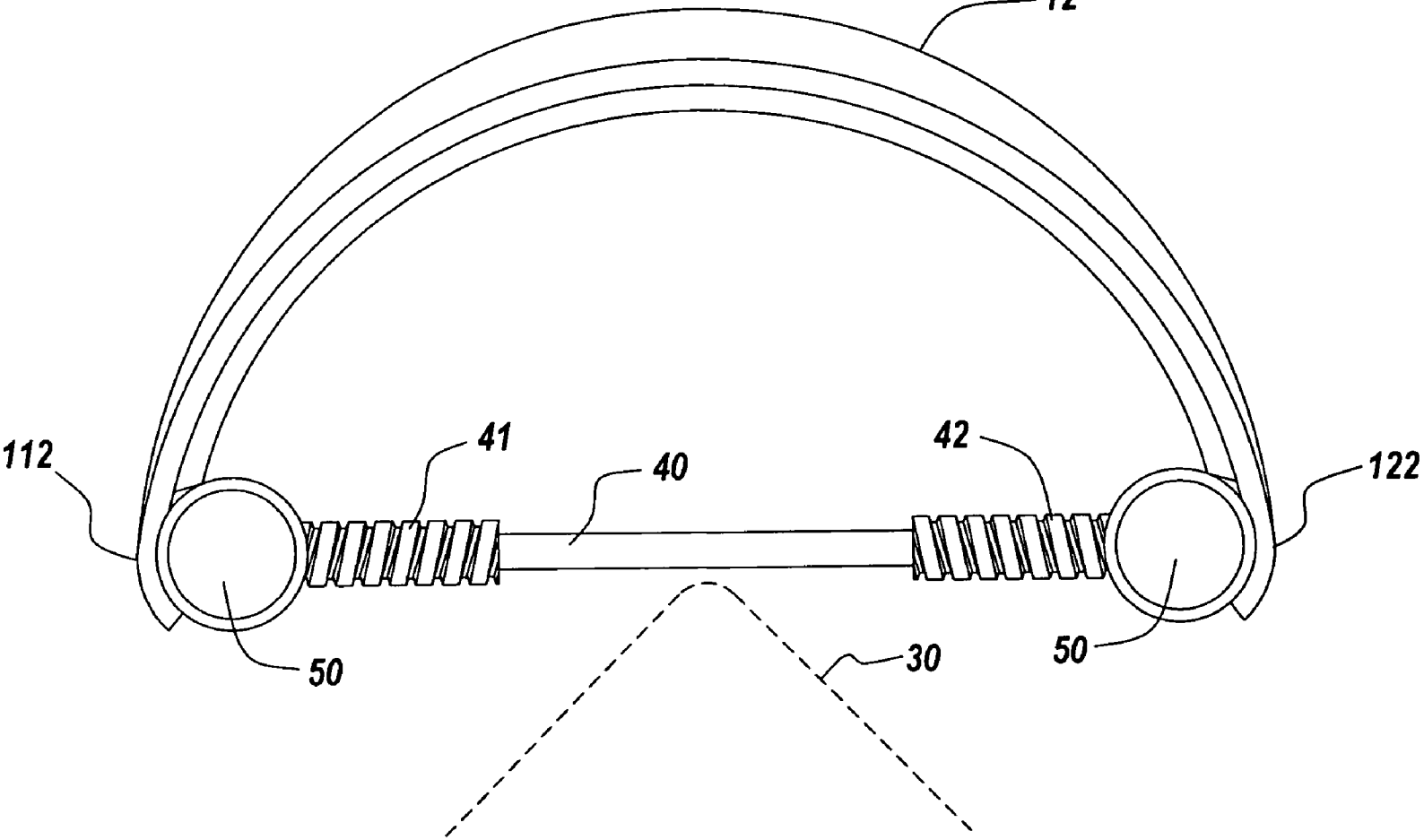
FIG. 3A is a diagrammatic top view of the adjustable rigid corner guard, according to one aspect of the present invention.
Figure 3B:
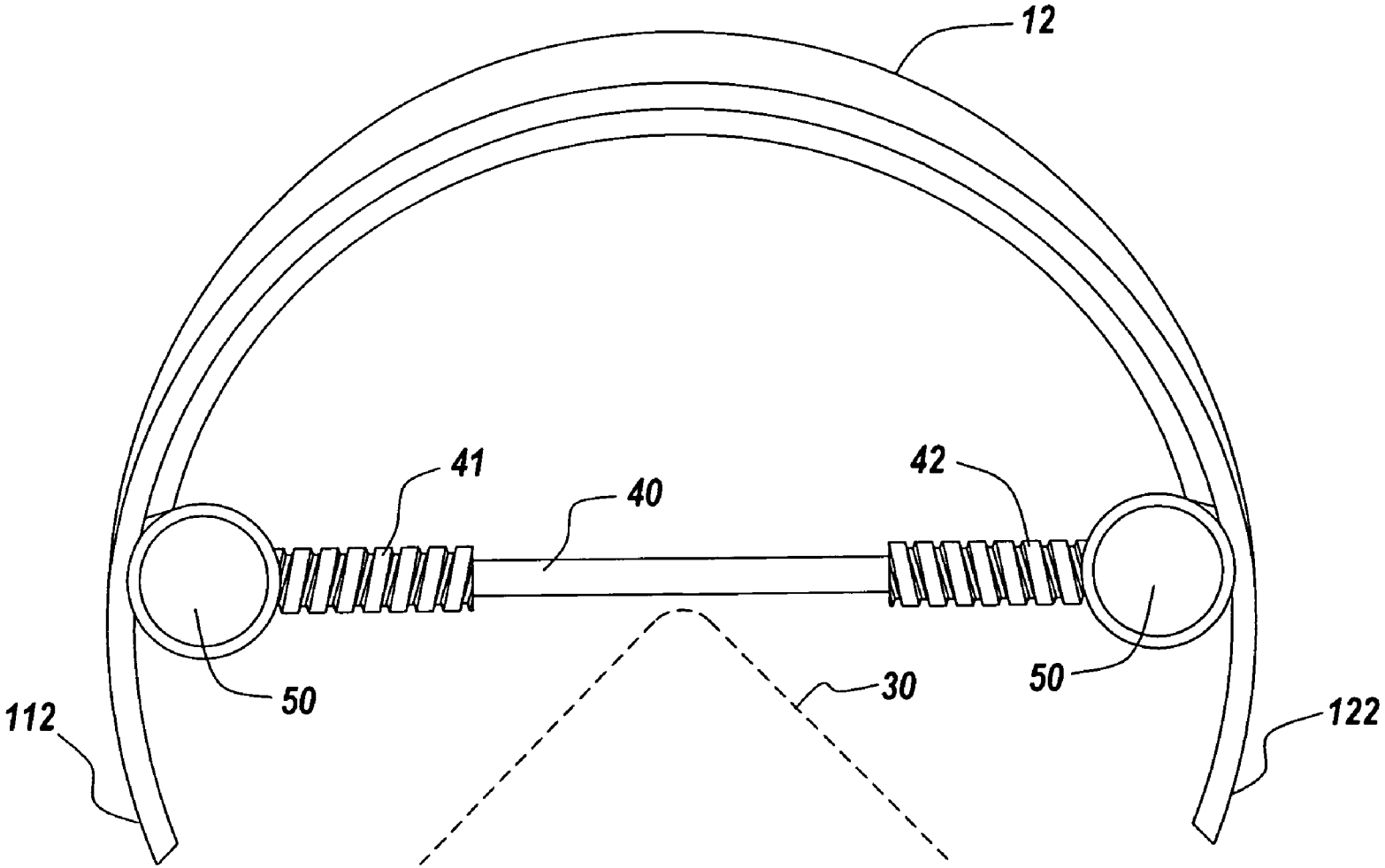
FIG. 3B is a diagrammatic top view of the adjustable rigid corner guard where a bumper section extends laterally significantly beyond a leg structure, according to one aspect of the present invention.
Figure 4A:
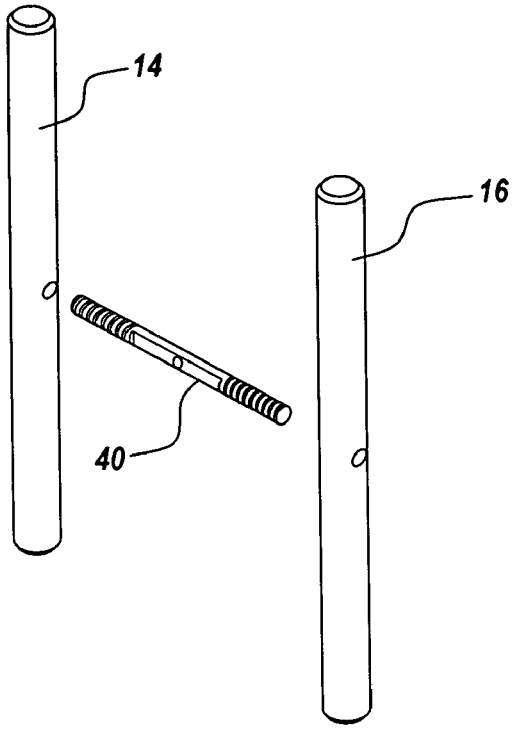
FIG. 4A is an exploded perspective view of the legs and adjustment mechanism of the corner guard, according to one aspect of the present invention.
Figure 4B:
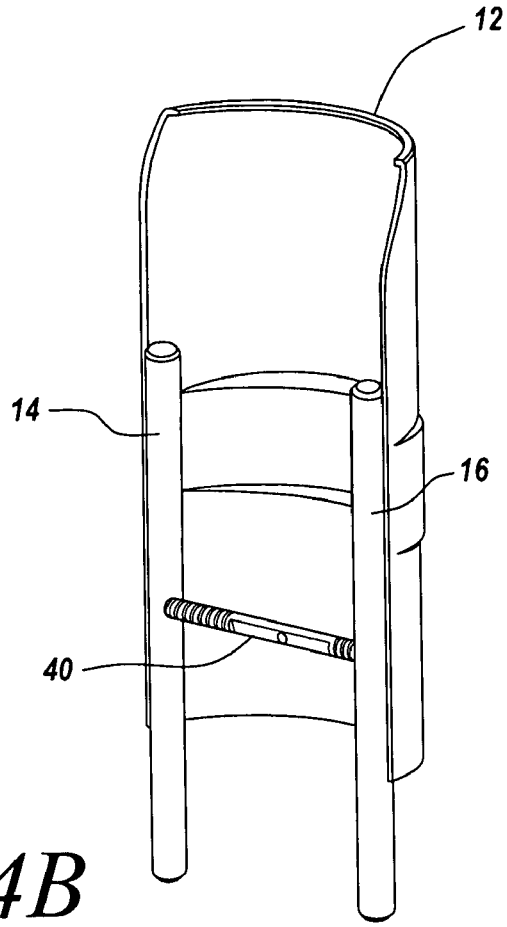
FIG. 4B is a perspective view of the legs and adjustment mechanism of the corner guard assembled, according to one aspect of the present invention.

The adjustable rigid corner guard 10 can have a number of different configurations, while still providing the desired level of protection of a corner upon which, or in front of which, it mounts. Referring now to FIGS. 1-7B, one example embodiment will now be described. Primarily, the adjustable rigid corner guard 10 is configured for absorbing the impact of collisions and protecting corners of fixtures and/or walls. The bumper section 12 includes a front right side face 110 and a front left side face 120. The front right side face 110 and front left side face 120 are essentially opposite ends of a generally arcuate shaped horizontal cross-section. However, the front right side face 110 and front left side face 120 can likewise be substantially orthogonal to each other and meet in a rounded edge in-between; or alternatively may intersect at other angles other than the perpendicular, so as to surround the periphery of a corner 30. Both the front right side face 110 and the front left side face 120 provide an extended vertical surface to protect the corner 30 adequately. A right side edge 112 and a left side edge 122 are preferably beveled, as is a top 130 of the bumper section 12, and also a base 140, in order to eliminate any sharp edges on the adjustable rigid corner guard 10. However, other types of edge finishes are considered within the scope of the invention. The front wall, formed by the front right side face 110 and front left side face 120, essentially surrounds the corner 30 of a structure that is to be protected. Additionally, the bumper section 12 can extend laterally substantially beyond the leg structure as shown in FIG. 3B. This obscures the view of the back side of the bumper section 12 of the adjustable rigid corner guard 10 after installation, and may provide a greater area of protection for the corner 30 of the structure.

In accordance with one example embodiment of the present invention, the adjustable rigid corner guard 10 includes a rub rail 28 that extends horizontally across the front right side face 110 to the front left side face 120 of the adjustable rigid corner guard 10. The rub rail 28 runs parallel to the base and forms a bulge or outwardly projecting surface feature in the front of the bumper section 12, extending outwardly from the front wall, to receive the initial impact of any collision. The rub rail 28 is integral with the bumper section 12. It should be noted that the configuration of the rub rail 28 can vary, such that other type protrusions, such as a wedge or rectangular bulge, can form the rub rail 28 within the scope of the present invention, such that the rub rail 28 is not limited to the configuration illustrated herein.

Figure 5:
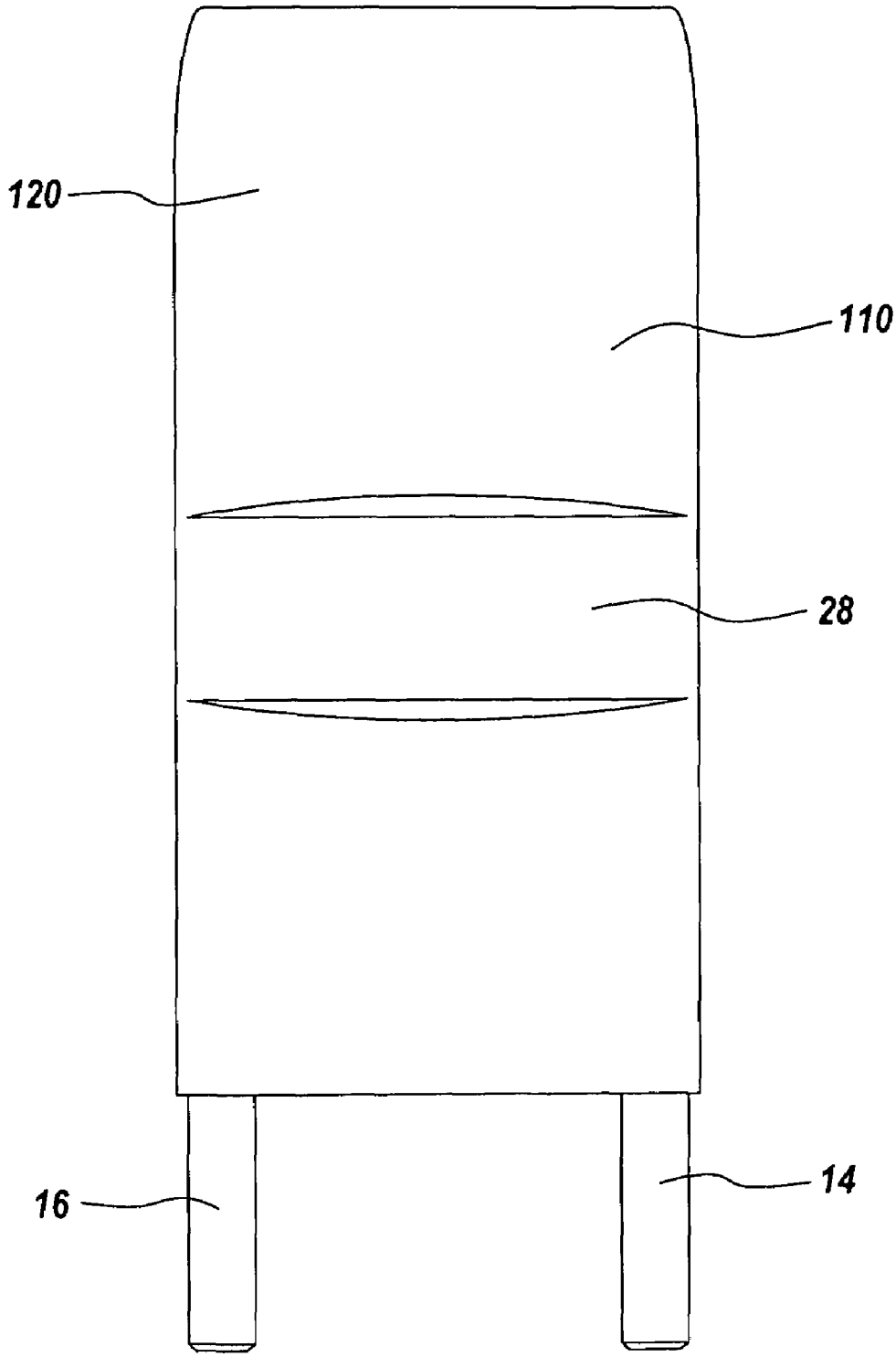
FIG. 5 is a front view of the adjustable rigid corner guard with a rub rail, according to one aspect of the present invention.
Figure 6:
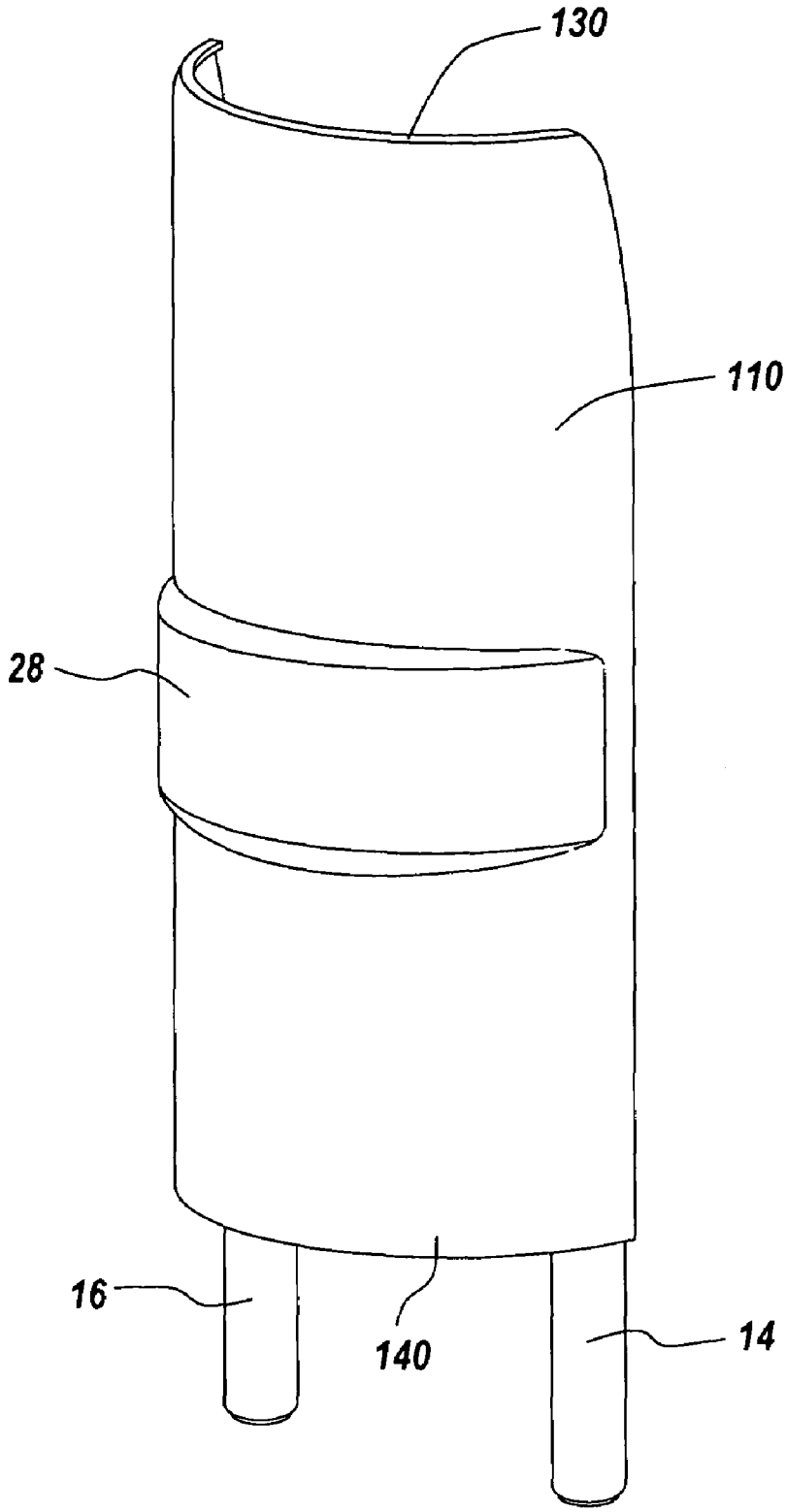
FIG. 6 is a perspective view of the front of the adjustable rigid corner guard, according to one aspect of the present invention.

Referring now to FIGS. 5 and 6, the vertical height of bumper section 12 is designed to be substantially larger than the width of either the front right side face 110 or the front left side face 120. The rub rail 28, which extends horizontally across the front right side face 110 and the front left side face 120 is positioned a short distance up from the base, and protrudes a short distance out from the respective front right and left side faces 110 and 120.

Referring back to FIG. 3, FIG. 4A, and FIG. 4B, there is shown a top view of the adjustable rigid corner guard 10, and two perspective views. The difficulty in making a corner guard with a rigid body that is strong enough to withstand impacts from heavy machinery or objects, potentially at higher velocities, is that the installation of such a guard can be hindered by slight variances in the distance between the mounting holes into which the legs of the guard are placed. With a softer material used to form the main body of the corner guard, the body can be compressed or slightly deformed to adjust the distance between the two or more legs to enable them to fit in existing mounting hose. However, if the body is too rigid (to withstand greater impacts) it can be very difficult to still maintain some flexibility in the placement of the mounting holes relative to the distance between the supporting legs of the guard. With the present invention, an adjustment mechanism 40 is provided that includes a rod with opposite orientation threading 41, 42. In the example embodiment illustrated, the rod of the adjustment mechanism 40 extends between the right side edge 112 and left side edge 122 of the bumper section 12. The adjustment mechanism 40 couples with the right side edge 112 and left side edge 122 at couplings 50. The couplings 50 can be fixed or can provide some rotation or pivoting capability, if desired, to allow rotation about a vertical axis through the couplings. The adjustment mechanism 40 includes the opposite orientation threading 41, 42, which operates to pull the right side edge 112 and left side edge 122 closer together when rotated in a first direction, and to push the right side edge 112 and left side edge 122 farther apart when rotated in an opposite direction.

With the rotation of the adjustment mechanism 40 in the first direction to pull the right and left side edges 112, 122 together, contemporaneous movement of the first and second legs 14, 16 occurs, and the distance D therebetween is reduced. With the rotation of the adjustment mechanism 40 in the opposite second direction to push the right and left side edges 112, 122 apart, contemporaneous movement of the first and second legs 14, 16 occurs, and the distance D therebetween is increased.

One of ordinary skill in the art will appreciate that the first and second leg supports 18, 20 can take a number of different forms, and are merely intended to provide sufficient support coupling the bumper section 12 with the first and second legs 14, 16 in a manner that will allow the adjustable rigid corner guard 10 to receive predictable impact levels from carts, and the like, as described, while protecting the corner 30 in front of which the adjustable rigid corner guard 10 is mounted.

The primary function of the adjustment mechanism 40 is to couple the front right side face 110 and the front left side face 112 together in a manner that enables or allows for a flexing of the bumper section 12 of the adjustable rigid corner guard 10 to affect the distance D between the first and second legs 14, 16 when installing the adjustable rigid corner guard 10. The flexing of the bumper section 12 along provides both increasing and decreasing adjustment of the distance D between the first leg 14 and the second leg 16. As such, if during an installation process, mounting holes 44 and 46 into which the first leg 14 and the second leg 16 are intended to fit are not precisely spaced at the exact distance between the first leg 14 and the second leg 16 without flexing the bumper section 12, then a user performing the installation can adjust the distance D as necessary using the adjustment mechanism 40.

Specifically, during installation, the distance D can be adjusted by an installer by applying a force to the front right side face 110 and the front left face section 112, either expanding them apart to increase distance D or compressing them together to decrease distance D. Thus, if any minor adjustments are required based on the placement of the mounting holes 44, 46 in the ground, the installer can flex the bumper section 12 using the adjustment mechanism 40, to line up the first and second legs 14, 16 to match up with the mounting holes 44, 46.

It should be noted that in the illustrative embodiment the first and second legs 14, 16 are welded to the bumper section 12 of the adjustable rigid corner guard 10. Accordingly, the adjustable rigid corner guard 10 maintains superior strength and impact resistance properties to plastic bumpers, while still having the ability to accommodate minor installation misalignments.

In accordance with one example embodiment, several adjustable rigid corner guards 10 were constructed. The bumper sections 12 ranged between 12 inches in height, to 18 inches in height, to 24 inches in height. With such dimensions, the flexibility provided by the adjustment mechanism 40 enabled variation of the dimension D between the first and second legs 14, 16 on the order of about ¼ inch in each direction (increasing and decreasing).

Figure 7A:
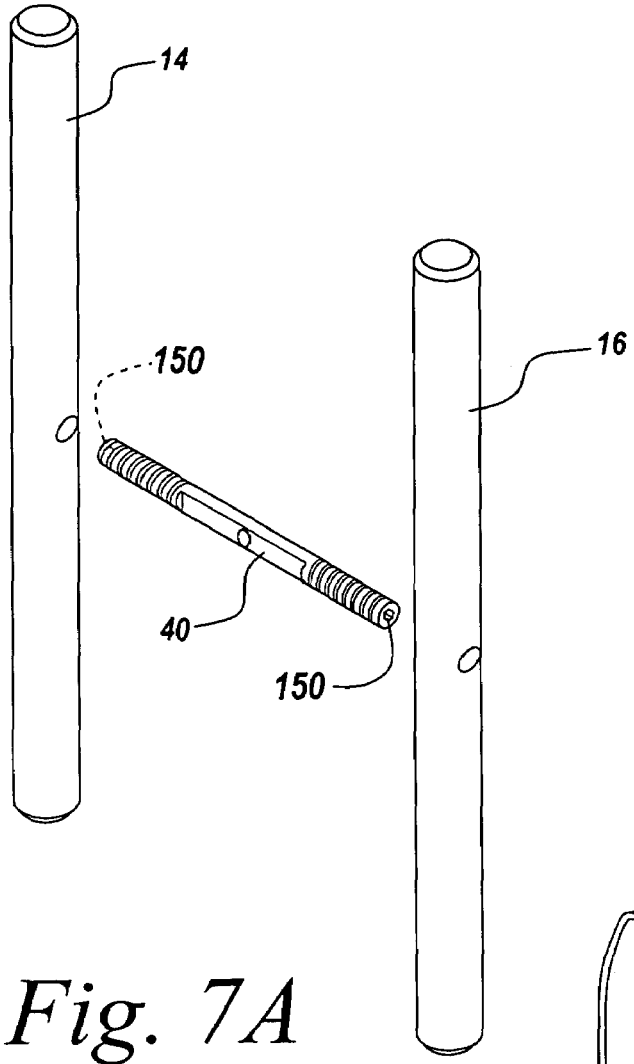
FIG. 7A is an exploded perspective view of the legs and adjustment mechanism of the corner guard where the adjustment mechanism includes hexagonal sockets, according to one aspect of the present invention.
Figure 7B:
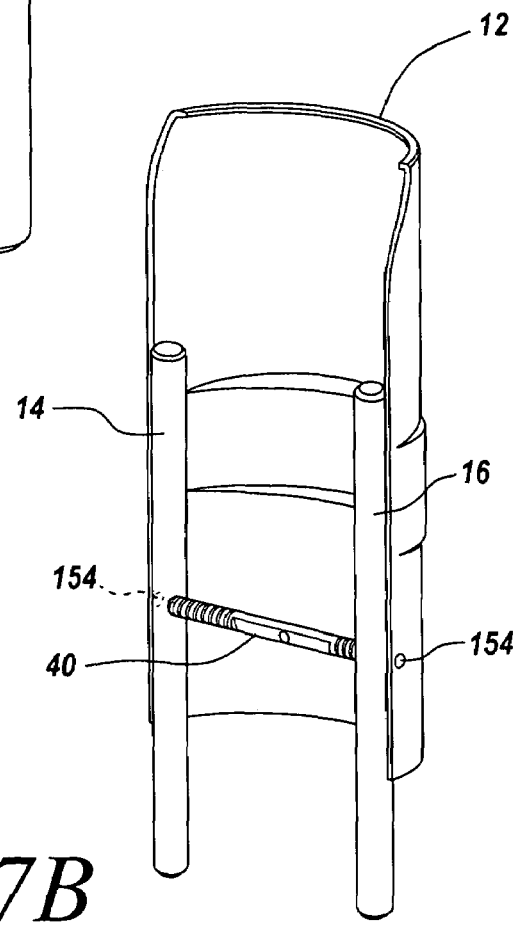
FIG. 7B is a perspective view of the legs, adjustment mechanism, and the bumper section of the corner guard assembled where the bumper section includes adjustment access holes, according to one aspect of the present invention.

Another illustrative embodiment shown in FIGS. 7A and 7B, allows the installer to change the distance D from a front of the bumper section 12, without necessarily requiring access to a back of the bumper section 12. The adjustment mechanism 40 has hexagonal sockets 150 at both ends that allow rotation of the adjustment mechanism 40 using a hexagonal wrench or an allen wrench. The bumper section 12 has adjustment access holes 154 that allow access to the hexagonal sockets 150 from the front side of the bumper section 12. An installer could move the adjustable rigid corner guard 10 to near its installed position and then change the distance D from the front side of the bumper section 12 using a hexagonal wrench or an allen wrench. After the adjustable rigid corner guard 10 is installed, the adjustable rigid corner guard 10 could be secured or "locked into position" by changing the distance D, causing transverse frictional forces between the first and second legs 14, 16 and the sides of the holes in which they are mounted.

Another illustrative embodiment of the present invention is an adjustable bollard described in FIGS. 8A-13. The adjustable bollard has a rigid post body that can absorb impact forces from heavy equipment or vehicles. The adjustable bollard also has a leg structure secured to the rigid post body to facilitate installation by requiring relatively small mounting holes. A distance between leg portions of the leg structure is adjustable, reducing the precision required for placement of the mounting holes, and, reducing the difficulties associated with installation. Additionally, changing the distance between leg portions after the bollard has been installed allows the bollard to be "locked" in place.

Figure 8C:
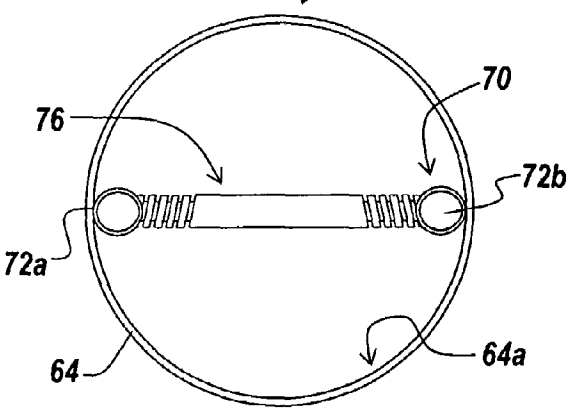
FIG. 8C is an enlarged diagrammatic top view of the bollard depicted in FIG. 8A.
Figure 8B:
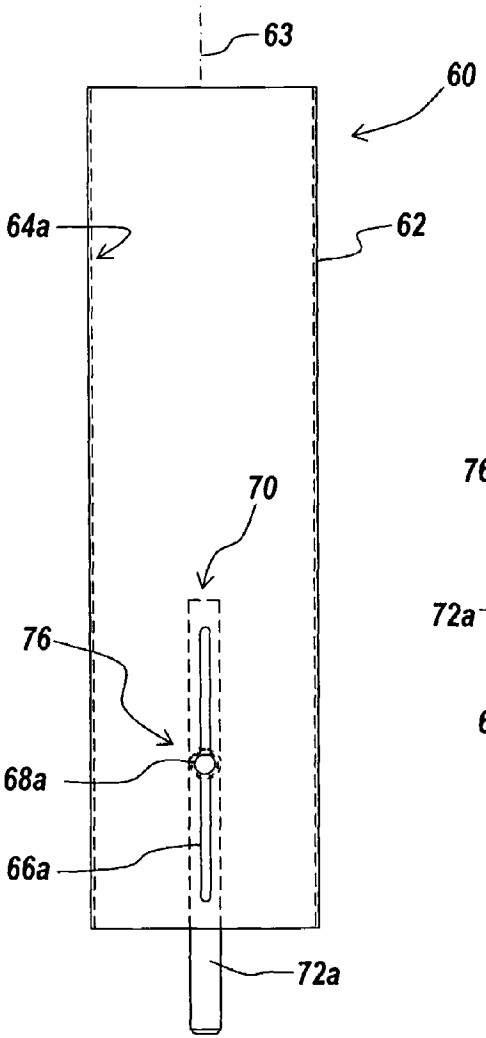
FIG. 8B is a diagrammatic side view of the bollard depicted in FIG. 8A.
Figure 8A:
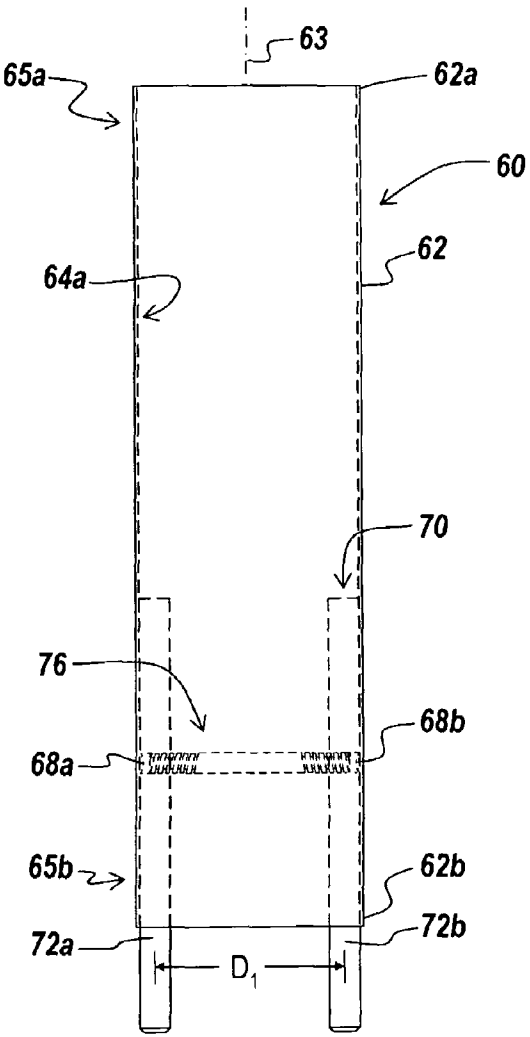
FIG. 8A is a diagrammatic front view of an adjustable bollard that is another illustrative embodiment of the present invention.

FIGS. 8A through 8C depict different views of an illustrative adjustable bollard 60 in accordance with one embodiment of the present invention. The adjustable bollard 60 includes a rigid post body 62 with a top end 62*a* and a bottom end 62*b*, and a leg structure 70 secured to the rigid post body 62 proximal to a base portion 65*b* of the rigid post body 62. The leg structure 70 can be secured to an inner side 64*a* of a wall 64 of the rigid post body 62. The leg structure 70 includes at least two leg portions 72*a*, 72*b* that are separated by a predetermined distance $D_1$. The adjustable bollard 60 also includes an adjustment mechanism 76 that is coupled to the rigid post body 62 and/or the at least two leg portions 72*a*, 72*b*. The adjustment mechanism 76 is configured to apply a force to the rigid post body 62 to flex the rigid post body 62 (either directly or through the at least two leg portions 72*a*, 72*b*) to adjust the predetermined distance $D_1$ for installation of the at least two leg portions 72*a*, 72*b*.

An adjustable bollard 60 of the present invention, must withstand impacts from heavy equipment. The adjustable bollard 60 can be formed of a number of different rigid and high strength materials, such as metal and high strength composites, so long as the material provides sufficient support and durability to withstand an impact with heavy equipment. The material of the rigid post body 62 must be sturdy enough to absorb the impact of many collisions while maintaining an attractive appearance, and not easily fractured or dented. The rigid post body 62 of the adjustable bollard 60 can be formed of a steel, a composite material or another material with a high yield stress, preferably a material with a tensile yield strength of greater than about 150 MPa. For example, as shown in table 1, series 300 alloys of stainless steel, and 1008 steel, a popular alloy for cold-rolled steel, both have sufficient tensile strength. A suitable material must also be sufficiently tough to prevent fracture. Additionally, the structural details, such as wall thickness, and material properties of the rigid post body 62 must be selected such that the rigid post body 62 can adequately flex in response to a force exerted using the adjustment mechanism 76.

Figure 13:
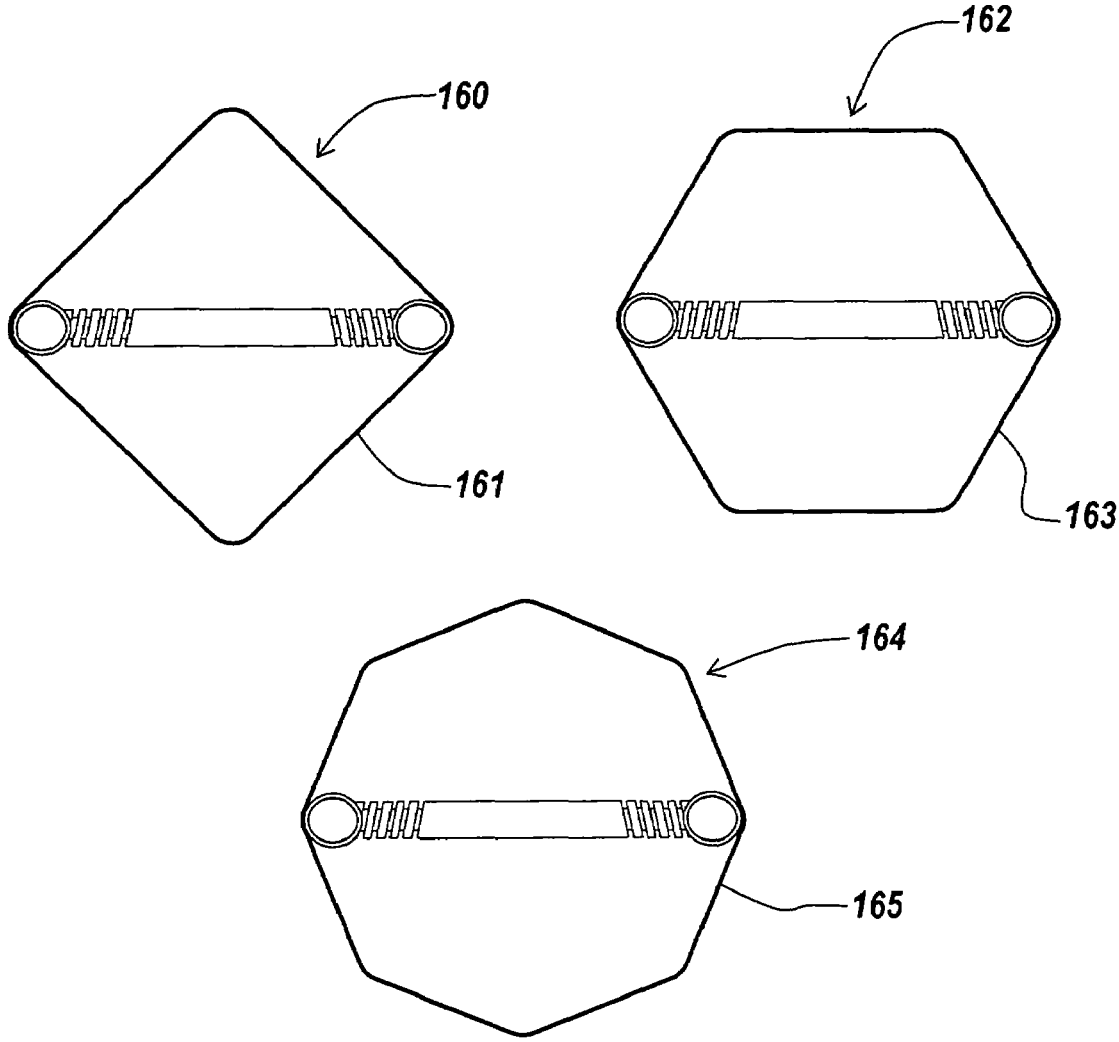
FIG. 13 diagrammatically depicts top views of embodiments of the bollard with polygonal rigid post body cross-sections, according to aspects of the present invention.

FIG. 8C depicts an enlarged top view of the adjustable bollard 60 viewed along a central axis 63 of the rigid post body 62. Although the illustrative adjustable bollard 60 has a rigid post body 62 with a circular or elliptical cross-section viewed along the central axis 63, other embodiments of an adjustable bollard may have polygonal cross-sections of the rigid post body, as shown in FIG. 13. One of ordinary skill in the art will appreciate that any number of different cross-sectional configurations are possible. Thus, the present invention is by no means limited to the specific examples shown.

Figure 9B:
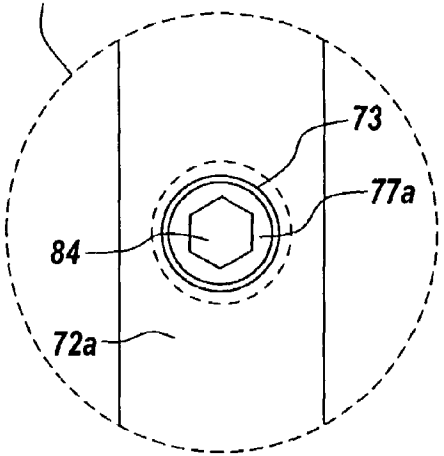
FIG. 9B is an enlarged diagrammatic view of a portion of the leg structure along a central axis of a cylindrical portion.
Figure 9A:
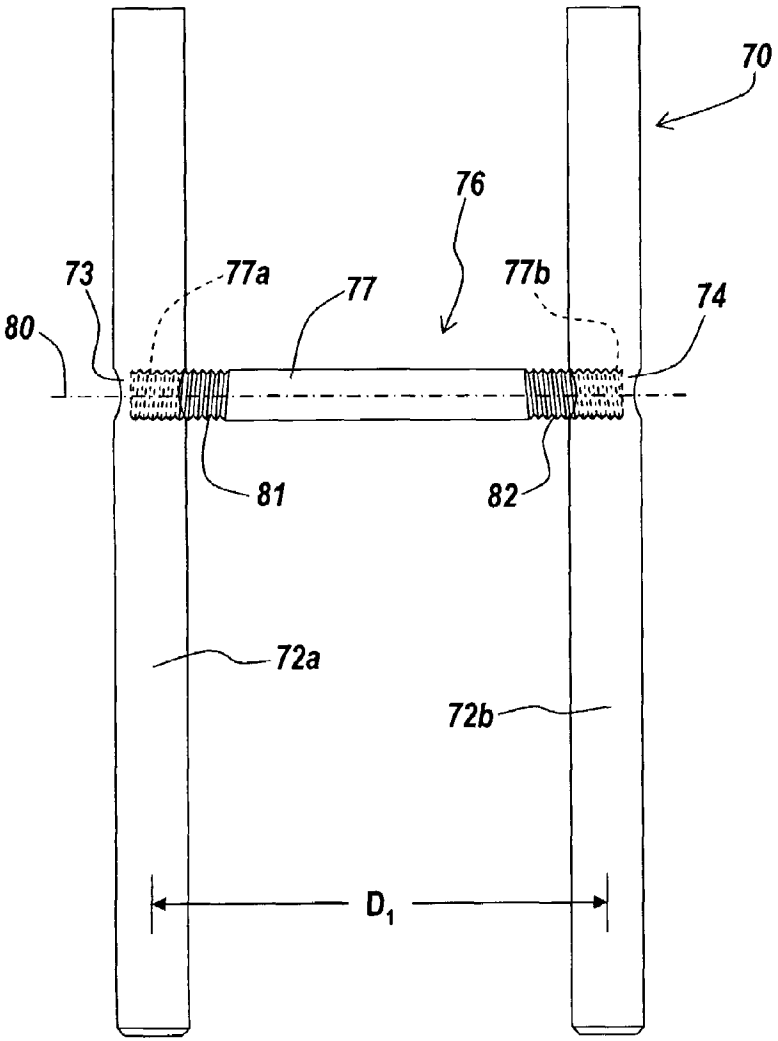
FIG. 9A is a diagrammatic front view of a leg structure, according to aspects of the present invention.

FIGS. 9A and 9B diagrammatically illustrate details of the leg structure 70 and the adjustment mechanism 76. The leg structure 70 and the adjustment mechanism embodiments of the adjustable bollard can include any aspects of the first leg 14, the second leg 16, and the adjustment mechanism 40 of the adjustable rigid corner guard 10 discussed previously and depicted in FIGS. 4A and 7A. As shown in FIG. 9A, an illustrative leg structure 70 comprises two leg portions 72*a* and 72*b* separated by the predetermined distance $D_1$. Although the illustrative leg structure 70 has two leg portions 72*a* and 72*b*, an adjustable bollard with a leg structure having more than two leg portions, with correspondingly more predetermined distances between them, falls within the scope of the present invention.

As shown, the two leg portions 72*a* and 72*b* can be joined by the adjustment mechanism 76, however, the adjustment mechanism 76 can instead be coupled with the rigid post body 62 or can be coupled with both the leg portions 72*a*, 72*b* and the rigid post body 62, according to aspects of the present invention. The adjustment mechanism 76 can include a cylindrical portion 77 that is threaded 81 in a first orientation at a first end 77*a* and that is reverse threaded 82 at a second end 77*b*. A cylindrical axis 80 extends through the center of the cylindrical portion 77 and along a length of the cylindrical portion 77. The first leg portion 72*a* can include a threaded hole 73 configured to mate with the threaded first end 77*a* of the cylindrical portion 77. The threaded hole 73 forms a first coupling that couples the threaded first end 77*a* of the cylindrical portion 77 to the rigid post body 62. The second leg portion 72*b* can include a reverse threaded hole 74 configured to mate with the reverse threaded second end 77*b* of the cylindrical portion 77, The threaded hole 74 forms a second coupling that couples the reverse threaded second end 77*b* of the cylindrical portion 77 to the rigid post body 62. Rotation of the cylindrical portion 77 about the cylindrical axis 80 in a first direction applies a force to flex the rigid post body 62 to reduce the predetermined distance $D_1$. Rotation of the cylindrical portion 77 about the cylindrical axis 80 in an opposite direction applies a force to flex the rigid post body 62 to increase the predetermined distance $D_1$. The adjustment range will depend on the materials used, the overall size of the bollard and the size of the predetermined distance.

In accordance with one particular example embodiment, an adjustable bollard, with a rigid post body made from a cold-rolled steel, has a predetermined distance $D_1$ of about 4.6 inches that can be increased or decreased by about 0.25 inches, resulting in a total adjustment range of about 0.5 inches. The adjustment range for each embodiment will depend on the materials used, the overall size of the bollard and the size of the predetermined distance.

An enlarged portion 90 of the leg structure 70 and adjustment mechanism 76 viewed along the cylindrical axis 80 is depicted in FIG. 9B. The threaded hole 73 in the first leg portion 72*a* allows the cylindrical portion 77 to be accessed through the leg portion 72*a*. As shown, the first end 77*a* of the cylindrical portion 77 can have a hexagonal shaped recess 84 that allows the cylindrical portion 77 to be rotated relative to the leg portions 72*a*,72*b* using a hexagonal key or a hexagonal-head wrench 102 (also see FIGS. 11A to 11C). The illustrative cylindrical portion 77 has a hexagonal shaped recess 84 on the first end 77*a* and another hexagonal shaped recess 84 on the second end 77*b* end to allow adjustment from either side. One of skill in the art will recognize that many other mechanisms that would adjust the predetermined distance $D_1$ fall within the scope of the present invention.

Figure 10B:
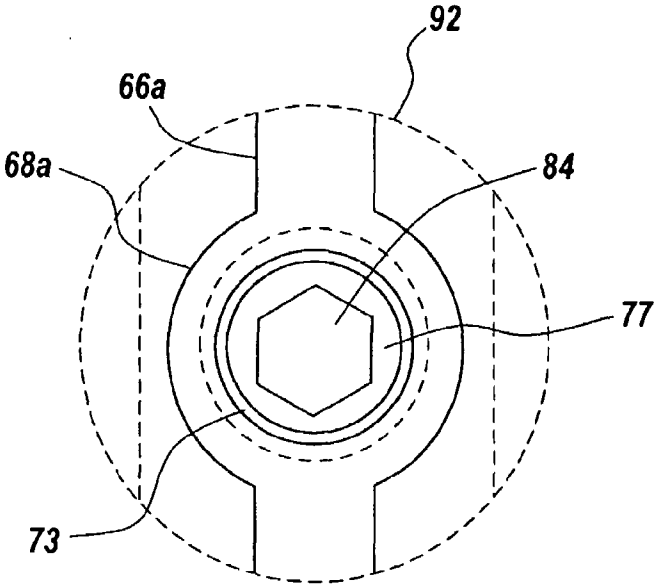
FIG. 10B is a further enlarged side view of a portion of the bollard depicted in FIG. 10A.
Figure 10A:
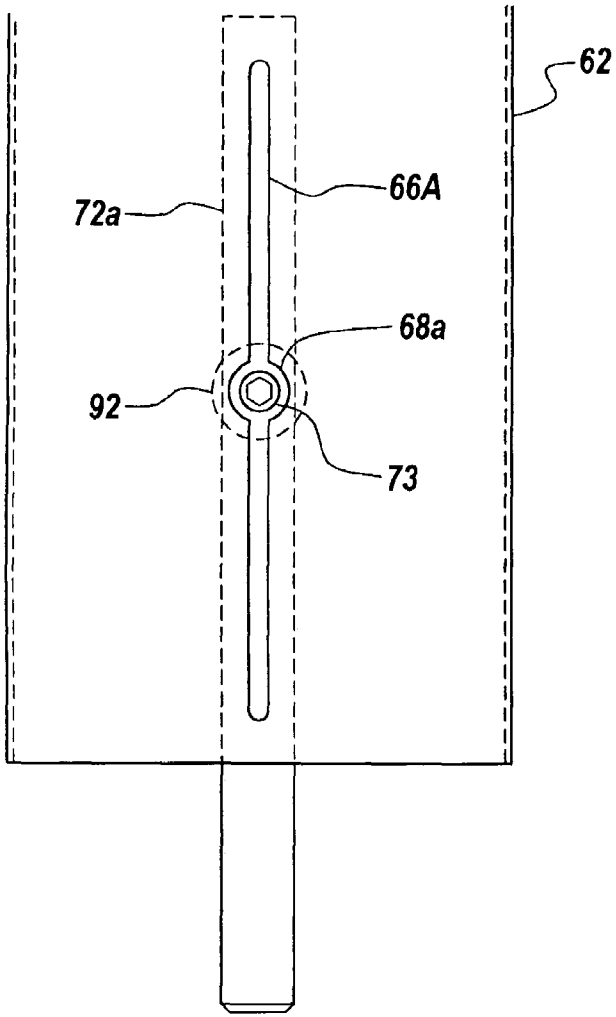
FIG. 10A is an enlarged diagrammatic side view of a portion of the bollard depicted in FIG. 8A.

FIG. 10A depicts an enlarged a side view of a portion of the adjustable bollard 60. According to aspects of the present invention, the rigid post body 62 can have at least one slot 66*a* parallel to the central axis 63 and at least one access hole 68*a* (see also FIG. 8B). The slot 66*a* allows the leg portion 72*a* to be secured to the rigid post body 62 using a plug welding technique. The leg portion 72*a* can be welded to the rigid post body 62 all along the length of the slot 66*a* except where an access hole 68*a* is located. Alternately, any other suitable technique or method could be employed to secure the leg portions 72*a*, 72*b* to the rigid body. The access hole 68*a* in the rigid post body 62 allows access to the adjustment mechanism 76 to change the predetermined distance $D_1$.

FIG. 10B depicts a further enlarged view of a portion 92 of the adjustable bollard 60. To change the predetermined distance, a hexagonal-head wrench 102 (see also FIGS. 11A through 11C) is inserted through the access hole 68*a* in the rigid post body 62, through the threaded hole 73 in the first leg portion 72*a*, and into the hexagonal shaped recess 84 in the first end 77*a* of the cylindrical portion 77, which forms a part of the adjustment mechanism 76. Rotating the hexagonal-head wrench 102 in one direction reduces the predetermined distance $D_1$. Rotating the hexagonal-head wrench 102 in an opposite direction increases the predetermined distance $D_1$.

Figure 11B:
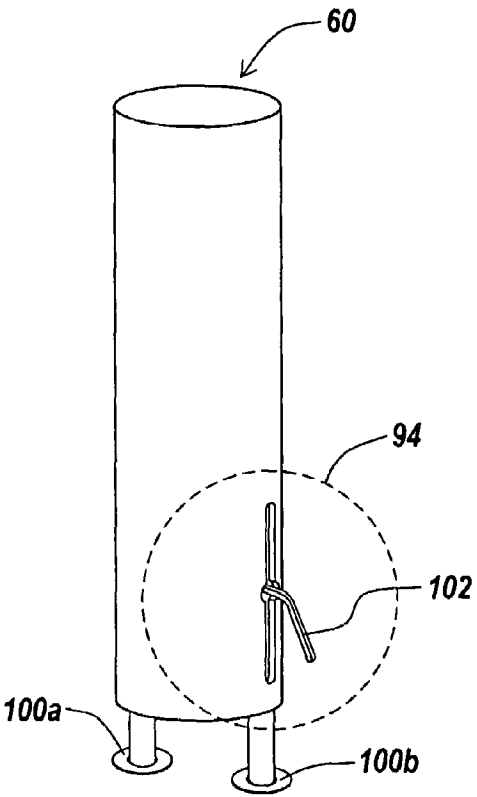
FIG. 11B diagrammatically illustrates the bollard after installation.
Figure 11C:
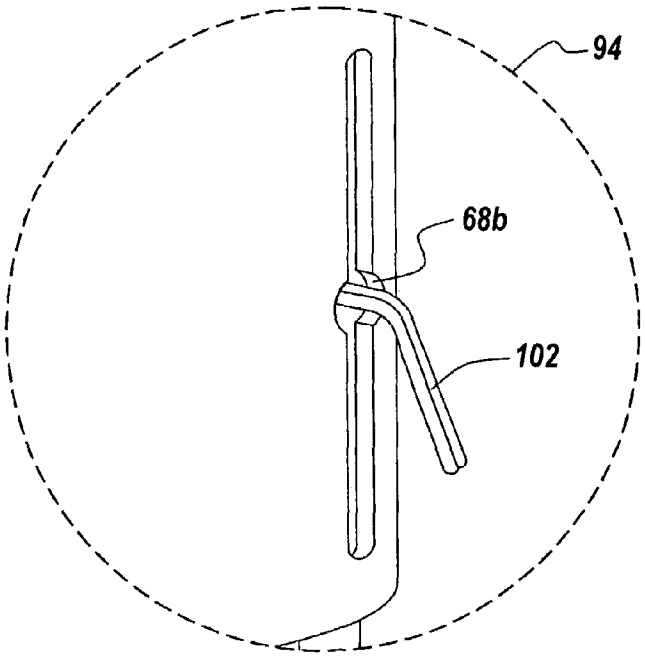
FIG. 11C is an enlarged view of a portion of the bollard after installation.
Figure 11A:
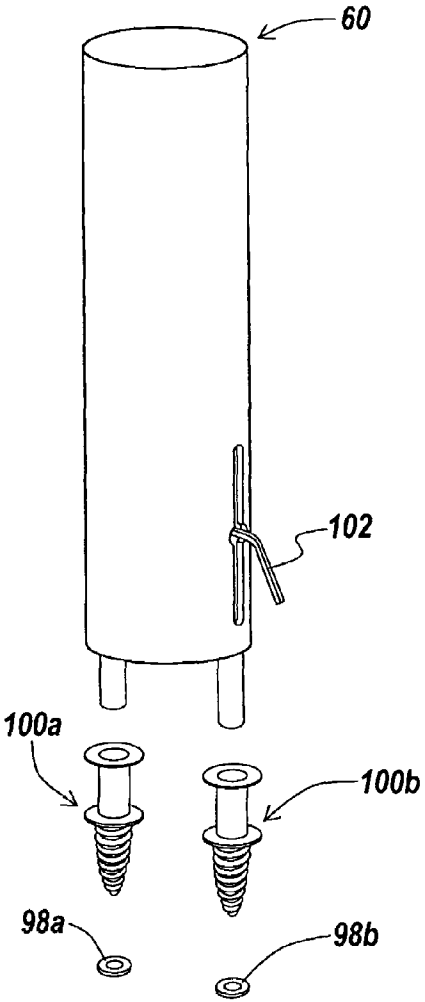
FIG. 11A diagrammatically illustrates installation of the bollard using floor anchors, according to one aspect of the present invention.

FIGS. 11A to 12B depict installation of the illustrative embodiment of the adjustable bollard 60. The leg portions 72*a*, 72*b* can be inserted directly into mounting holes 98*a*, 98*b* holes made in the floor or the ground (as shown in FIG. 12A), or alternately, the leg portions 72*a*, 72*b* can be inserted into drive anchors 100*a*, 100*b* which have been inserted in the mounting holes 98*a*, 98*b* in the floor or ground, as shown in FIGS. 11A and 11B. An example of a suitable drive anchor appears in U.S. Pat. No. 6,991,413. If the two mounting holes 98*a*, 98*b* are not precisely spaced at the exact distance between the first leg portion 72*a* and the second leg portion 72*b*, then a user performing the installation can adjust the distance $D_1$ as necessary using the adjustment mechanism 76. FIG. 11C depicts an enlarged view 94 of the allen wrench coupled with the adjustment mechanism 76 for adjusting the distance $D_1$. After the leg portions 72*a*, 72*b* have been inserted into the mounting holes 98*a*, 98*b*, or into the drive anchors 100*a*, 100*b* in the mounting holes 98*a*, 98*b* (as shown in FIG. 11B), the distance $D_1$ between the leg portions 72*a*, 72*b* can be adjusted to secure or "lock" the bollard in place through the transverse frictional forces between the leg portions 72*a*, 72*b* and the sides of the mounting holes 98*a*, 98*b* in which they are mounted.

Figure 12A:
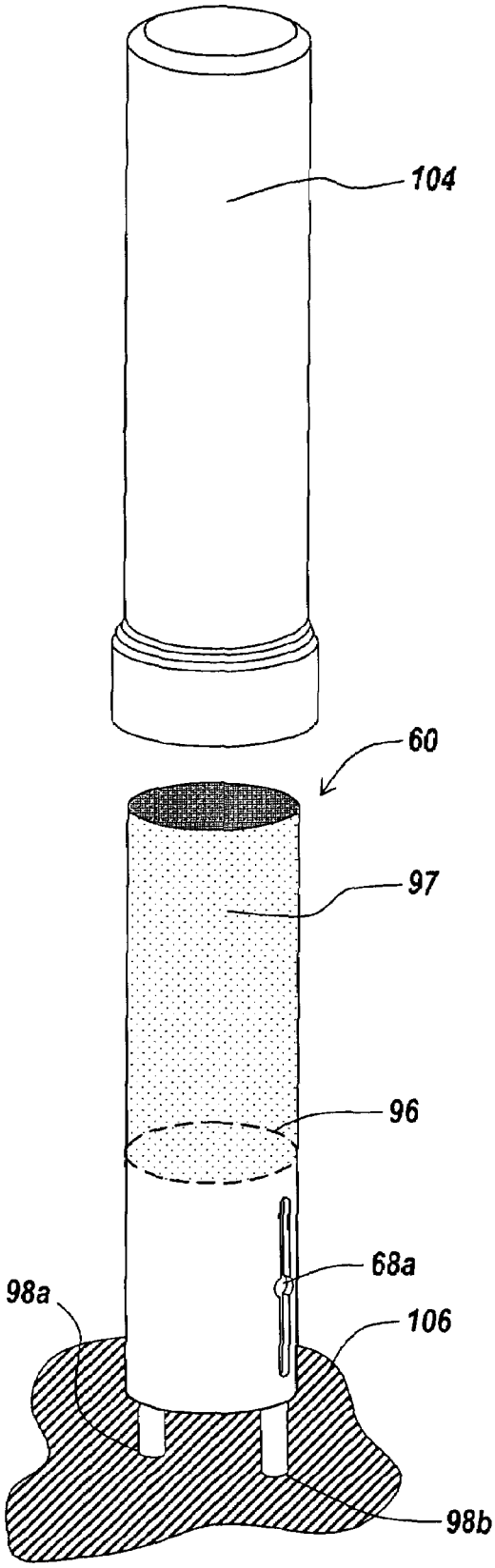
FIG. 12A diagrammatically illustrates use of a bollard cover according to an aspect of the present invention.
Figure 12B:
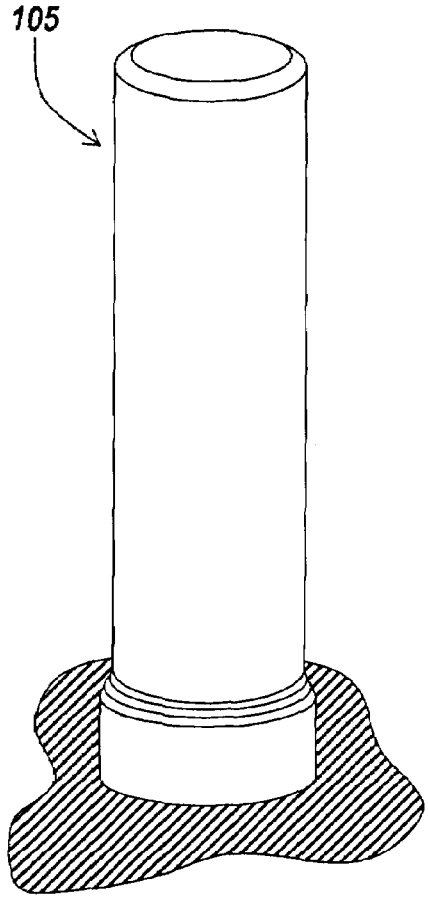
FIG. 12B diagrammatically illustrates the bollard after installation and after being covered with a bollard cover.

After the leg portions 72*a*, 72*b* are inserted into the mounting holes 98*a*, 98*b* and the adjustable bollard 60 has been locked into place (if desired), the hexagonal-head wrench 102 is removed, ballast 97 can be added and a bollard cover 104 can be placed on the adjustable bollard, as shown in FIGS. 12A and 12B. According to aspects of the present invention, the adjustable bollard can include ballast 97 such as concrete, sand, water. etc. to increase the mass of the adjustable bollard 60 and to increase its resistance to denting. As shown in FIG. 12A, the rigid post body 62 can include a shelf 96 that forms the bottom of a container for containing the ballast 97. The ballast 97 can be contained in the adjustable bollard 60 before installation, or the ballast 97 may be added to the adjustable bollard 60 after installation. According to other aspects of the present invention, a bollard cover 104 can be placed over the top of the rigid post body 62. A suitable bollard cover is described in U.S. Design Pat. No. D485,374. The bollard cover 104 blocks access to the one or more access holes 68*a*, 68*b* as well as improving the appearance of the adjustable bollard 60. The illustrative adjustable bollard 60 is removable by using the adjustment mechanism 76 to adjust the predetermined distance $D_1$ "unlocking" the bollard and pulling the bollard up out of the mounting holes 98*a*, 98*b*. If the bollard needs to be temporarily removed the two mounting holes 98*a*, 98*b* left behind do not present the level of floor hazard that single, larger diameter hole would present.

Although FIGS. 8A through 12B depict an adjustable bollard that is an illustrative embodiment of the present invention, one of ordinary skill in the art recognizes that many other embodiments of an adjustable bollard fall within the scope of the present invention. In particular, according to aspects of the present invention, the adjustable bollard can have more than two leg portions and there can be more that one adjustment mechanism that adjusts more than one predetermined distance between the more than two leg portions. The leg structure of the adjustable bollard can be substantially taller or shorter relative to a height of the rigid post body. The leg structure can be secured to an external side of the wall of the rigid post body or otherwise attached to the rigid post body. As shown in FIG. 13, embodiments of the adjustable bollard 160, 162 164 may have rigid post bodies 161, 163, 165 with cross-sections that are substantially polygonal instead of circular or elliptical. One embodiment of an adjustable bollard 160 has a substantially square cross-section of the rigid post body 161, another embodiment of an adjustable bollard 162 has a substantially hexagonal cross section of the rigid post body 163, and a third embodiment of an adjustable bollard 164 has a substantially octagonal cross section of the rigid post body 165. The example embodiments depicted are only some of the variations of an adjustable bollard that fall within the scope of the present invention.

Figure 14A:
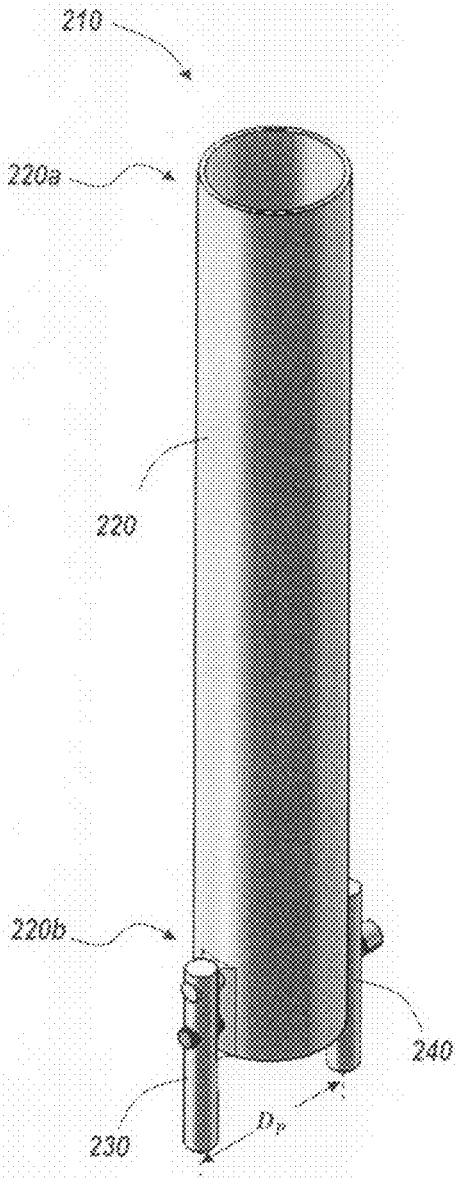
FIG. 14A is a diagrammatic perspective view of a bollard with an adjustable mounting mechanism that is another illustrative embodiment of the present invention.
Figure 14B:
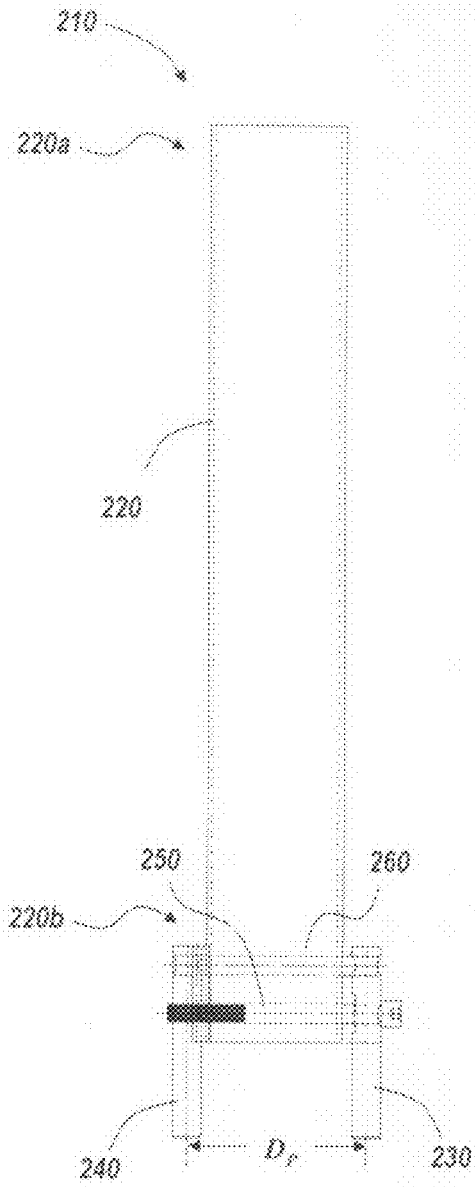
FIG. 14B is a diagrammatic side cross-sectional view of the adjustable mounting mechanism depicted in FIG. 14A.

FIGS. 14A and 14B diagrammatically depict an exemplary bollard 210 with an adjustable mounting mechanism, in accordance with another embodiment of the present invention. The bollard 210 includes a rigid post body 220 having a first end 220*a* and a second end 220*b*. The bollard 210 includes a first leg 230 coupled to the rigid post body 220 at the second end 220*b*. The bollard also includes a second leg 240 coupled to the rigid post body 220 at the second end 220*b* that is substantially parallel with the first leg 220. The second leg is coupled with the second end 220*b* through an adjustable support 250 that is configured to vary a distance Dp between the first leg 230 and the second leg 240 upon adjustment. The bollard 210 further includes a sliding support 260 slidably coupled with the first leg 230, the second leg 240, or both. The distance $D_P$ can be varied to adjust to a spacing between mounting holes on a floor and the distance $D_P$ can be varied to "lock" the bollard 210 in position after it is placed in the mounting holes. The bollard 210 may be configured to adjust the distance $D_P$, for example, by at least about ±0.25 inches or at least about 0.5 inches total range.

Figure 15A:
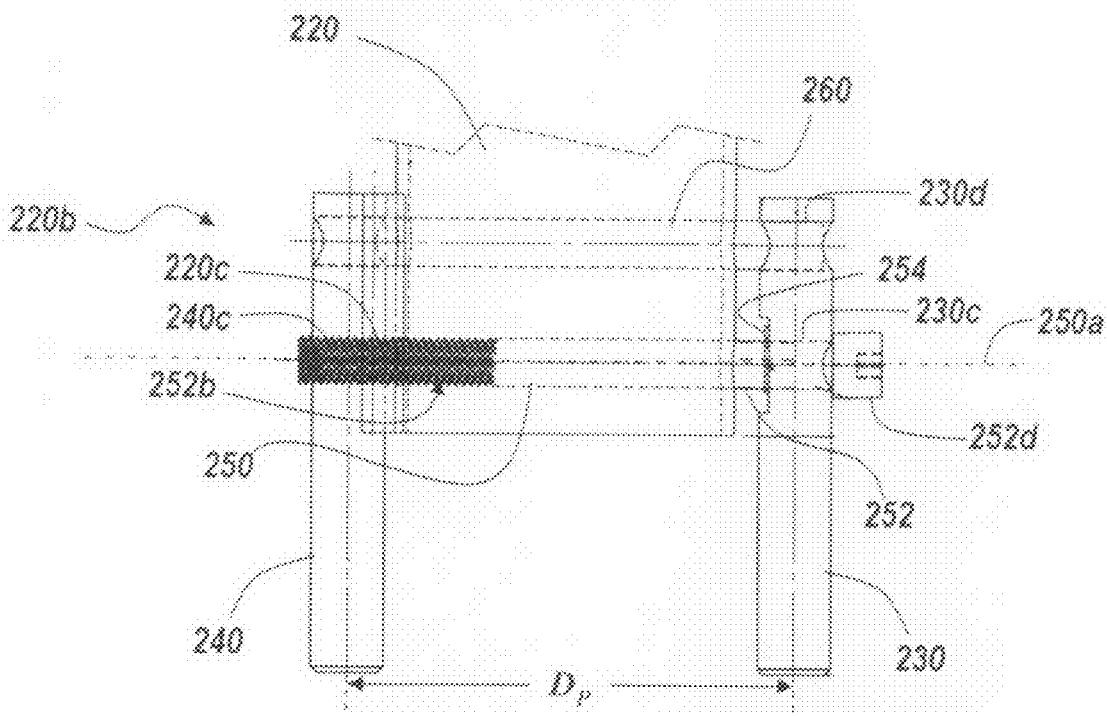
FIG. 15A is a diagrammatic side cross-sectional view of a bottom portion of the adjustable mounting mechanism, according to aspects of the present invention.
Figure 15B:
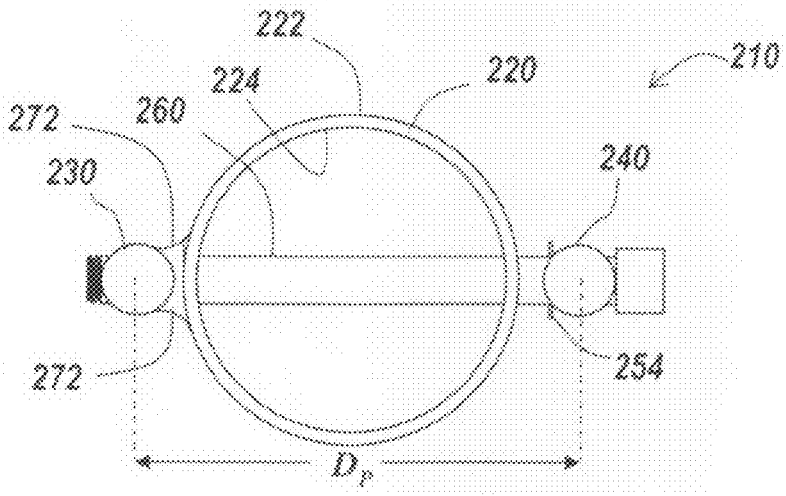
FIG. 15B is a diagrammatic top view of the adjustable mounting mechanism.

Both FIG. 15A and FIG. 15B illustrate further details of the exemplary bollard 210 according to aspects of the present invention. FIG. 15A depicts a diagrammatic side cross-sectional view of the second end 220*b* of the rigid post body 220, the first leg 230 the second leg 240, the adjustable support 250 and the sliding support 260, according to aspects of the present invention. FIG. 15B depicts a top view of the exemplary bollard 210.

According aspects of the present invention, rotation of the adjustable support 250 about a longitudinal axis of the adjustable support 250*a* varies the predetermined distance $D_P$ between the first leg 230 and the second leg 240. In accordance with the example embodiment, the adjustable support 250 includes a threaded bolt 252. The second leg 240 may include a threaded channel 240*c* configured to engage threads 252*b* on a portion of the threaded bolt 252. The rigid post body 220 may include a threaded channel 220*c* configured to engage threads 252*b* on a portion of the threaded bolt 252; however, this may not be necessary if threaded channel 240*c* exists, and vice versa threaded channel 240*c* may not be necessary if threaded channel 220*c* exists. The first leg 230 may include a channel 230*c* through which the threaded bolt 252 passes. The threaded bolt 252 may include a driving head 252*d* for rotating the adjustable support 250 about the longitudinal axis 250*a* of the adjustable support 250. The adjustable support may include a retaining element 254 adapted to fix a translational position of the adjustable support 250 relative to the first leg 230. The retaining element 254 may be disposed on the threaded bolt 252 and configured to retain the first leg 230 in a desired position along a length of the threaded bolt 252 with the first leg 230 disposed between the driving head 252*d* and the retaining element 254 as depicted.

According to aspects of the present invention, the sliding support 260 may be fixedly coupled with the rigid post body 220 and slidably coupled with the first leg 230. The first leg 230 may include a second channel 230*d* with the sliding support 260 passing therethrough for slidably coupling the first leg 230 and the sliding support 260. The sliding support 260 may be fixedly coupled with the second leg 240, the rigid post body 220, or both. The sliding support 260 may be fixedly coupled with the second leg 240 and/or the rigid post body 220 using at least one weld 272 as depicted in FIG. 15B. Alternately, any other suitable technique or method could be employed to secure the sliding support 260 with the rigid post body 220 and/or the second leg 240. The second leg 240 may be affixed to the rigid post body 220 and the sliding support 260 may be affixed to the second leg 240. The second leg may be affixed to an outward facing side 222 of a wall of the rigid body as depicted. Alternately the second leg may be affixed to an inward facing side of the rigid body 224.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the invention, and exclusive use of all modifications that come within the scope of the appended claims is reserved.

What is claimed is:

1. A bollard with an adjustable mounting mechanism comprising:

a rigid post body having a first end and a second end;

a first leg coupled with the rigid post body at the second end;

a second leg coupled with the rigid post body at the second leg substantially parallel with the first leg, the second leg coupled with the rigid post body through an adjustable support; wherein the adjustable support is configured to vary a distance between the first leg and the second leg upon adjustment; and a sliding support slidably and directly coupled to and within a channel of the first leg, the second leg, or both providing support to the first leg, the second leg, or both;

wherein a portion of the sliding support extends laterally between the first leg and the second leg, such that the first leg, the second leg, or both, is slidably supported as the adjustable support is used to vary the distance therebetween.

2. The bollard of claim 1, wherein the sliding support is fixedly coupled with the rigid post body and slidably coupled with the first leg.

3. The bollard of claim 2, wherein the second leg is affixed to the rigid post body and the sliding support is affixed to the second leg.

4. The bollard of claim 1, wherein the adjustable support comprises a threaded bolt.

5. The bollard of claim 4, wherein the rigid post body comprises a threaded channel configured to engage threads on a portion of the adjustable support.

6. The bollard of claim 4, wherein the second leg comprises a threaded channel configured to engage threads on a portion of the adjustable support.

7. The bollard of claim 1, wherein rotation of the adjustable support about a longitudinal axis of the adjustable support varies the predetermined distance between the first leg and the second leg.

8. The bollard of claim 7, wherein the adjustable support comprises a driving head for rotating the adjustable support about the longitudinal axis of the adjustable support.

9. The bollard of claim 1, wherein the adjustable support comprises a retaining element adapted to fix a translational position of the adjustable support relative to the first leg.

10. The bollard of claim 1, wherein the second leg is affixed to an outward facing side of a wall of the rigid post body.

11. The bollard of claim 1, wherein the second leg is affixed to an inward facing side of a wall of the rigid post body.

12. The bollard of claim 1, wherein the adjustable support configured to adjust the predetermined distance over a total range of about 0.5 inches.

13. A bollard with an adjustable mounting mechanism, comprising:

a rigid post body having a first end and a second end;

a leg structure coupled with and supporting the rigid post body, comprising:

a first leg coupled with the rigid post body at the second end;

a second leg coupled with the rigid post body at the second end substantially parallel with the first leg;

an adjustable support having a first end rotatably coupled with the first leg and a second end adjustably coupled with the second leg, wherein the adjustable support is configured to vary a distance between the first leg and the second leg upon adjustment; and a sliding support slidably coupled to and within a channel of the first leg and fixedly coupled to and within a channel of the second leg providing support to the first leg, the second leg, or both;

wherein a portion of the sliding support extends laterally between the first leg and the second leg, such that the first leg, the second leg, or both, is slidably supported as the adjustable support is used to vary the distance therebetween.

14. The bollard of claim 13, wherein the first leg comprises a first channel slidably engaged with the sliding support.

15. The bollard of claim 14, wherein the second leg comprises a threaded channel threadedly engaged with the adjustable support.

16. The bollard of claim 15, wherein the adjustable support comprises:

a threaded bolt having a driving head disposed at a first end and a threaded portion disposed at a second end; and a retaining element disposed on the threaded bolt adapted to retain the first leg in a desired position along a length of the threaded bolt; wherein the first leg is disposed between the driving head and the retaining element.

* * * * *